US010205259B2

(12) United States Patent
Wang et al.

(10) Patent No.: US 10,205,259 B2
(45) Date of Patent: Feb. 12, 2019

(54) FLAT FLEXIBLE CABLE CONNECTOR STRUCTURE

(71) Applicant: P-TWO INDUSTRIES INC., Taoyuan (TW)

(72) Inventors: Chien-Chun Wang, Taoyuan (TW); Wen-Lun Wang, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 15/853,932

(22) Filed: Dec. 25, 2017

(65) Prior Publication Data

US 2019/0020139 A1 Jan. 17, 2019

(30) Foreign Application Priority Data

Jul. 13, 2017 (CN) ..... 2017 2 0846650 U

(51) Int. Cl.

| | |
|---|---|
| ***H01R 12/77*** | (2011.01) |
| ***H01R 12/79*** | (2011.01) |
| ***H01R 13/627*** | (2006.01) |
| ***H01R 13/639*** | (2006.01) |
| ***H01R 12/59*** | (2011.01) |
| ***H01R 12/52*** | (2011.01) |
| ***H01R 13/58*** | (2006.01) |
| ***H01R 13/633*** | (2006.01) |

(52) U.S. Cl.

CPC ..... *H01R 12/79* (2013.01); *H01R 12/52* (2013.01); *H01R 12/592* (2013.01); *H01R 12/774* (2013.01); *H01R 13/5829* (2013.01); *H01R 13/6272* (2013.01); *H01R 13/633* (2013.01); *H01R 13/639* (2013.01)

(58) Field of Classification Search

CPC .... H01R 12/77; H01R 12/771; H01R 12/775; H01R 12/52; H01R 12/59; H01R 12/78; H01R 12/61; H01R 13/72

See application file for complete search history.

(56) References Cited

U.S. PATENT DOCUMENTS 6,238,227 B1 * 5/2001 Wu ..... H01R 12/774 439/260
6,648,668 B1 * 11/2003 Ko ..... H01R 13/6275 439/353
6,793,527 B2 * 9/2004 Noro ..... H01R 12/594 439/497

(Continued)

*Primary Examiner* — Vanessa Girardi
(74) *Attorney, Agent, or Firm* — Winston Hsu

(57) ABSTRACT

A connector structure includes a first metal housing, a flexible flat transmission component and a second metal housing. The first metal housing includes an installation portion and two guiding portions disposed on two sides of the installation portion. Each guiding portion includes a bottom section, a top section opposite to the bottom section, and a bending section connected to the bottom section and the top section. A slot is formed on the bottom section, and an extending section extends from the top section and toward the bottom section to engage inside the slot. The flexible flat transmission component is disposed on the installation portion and includes a plurality of contacts. The second metal housing is assembled with the first metal housing and covers the flexible flat transmission component, and the plurality of contacts exposes out of the second metal housing.

10 Claims, 4 Drawing Sheets

(56) References Cited

U.S. PATENT DOCUMENTS

| | | | | |
|---|---|---|---|---|
| 7,850,473 | B1 * | 12/2010 | Ozeki | H01R 23/661<br>439/260 |
| 8,808,020 | B2 * | 8/2014 | Ikari | H01R 12/7029<br>439/153 |
| 2014/0357123 | A1 * | 12/2014 | Aoki | H01R 13/6581<br>439/607.55 |

* cited by examiner

FLAT FLEXIBLE CABLE CONNECTOR STRUCTURE

BACKGROUND OF THE INVENTION

1. Field of the Invention

The present invention relates to a connector structure, and more particularly, to a connector structure with a slim size and low manufacturing cost.

2. Description of the Prior Art

Due to high signal flow between a liquid crystal display and a system host, a low voltage differential signal (LVDS) receiver with an ultra-high speed of 1.4 Gb/s, low power consumption and low electromagnetic radiation is used in a current high-frequency signal transmission system installed between a liquid crystal display interface and a system host board interface, as the signal transmission interface for the liquid crystal display interface. A signal connection is established between the receiver and the signal transmission interface on the system host board interface, i.e. the connector socket on the system host board interface, through the connection of a signal transmission line, and a conventional LVDS signal transmission system is thus composed.

Generally, a male connector of the conventional LVDS signal transmission system includes an upper iron shell, an insulating main body, a conductive terminal, a flexible flat cable and a lower iron shell. The insulating main body is installed on the lower iron shell first, the conductive terminal is inserted into the insulating main body, the conductive terminal is connected to the flexible flat cable, and the upper iron shell is installed on the insulating main body at last. Therefore, this conventional connector has complicated structure, complicated assembly and high manufacturing cost. Besides, this conventional connector also has a large size, which cannot meet slim and light design trends of electronic products.

SUMMARY OF THE INVENTION

Therefore, an objective of the present invention is to provide a connector structure with a slim size, simple structure, easy assembly and low manufacturing cost, which can meet slim and light design trends of electronic products, for solving the aforementioned problems.

In order to achieve the aforementioned objective, the present invention discloses a connector structure including a first metal housing, a flexible flat transmission component and a second metal housing. The first metal housing includes an installation portion and two guiding portions disposed on two sides of the installation portion. Each guiding portion includes a bottom section, a top section opposite to the bottom section, and a bending section connected to the bottom section and the top section. A slot is formed on the bottom section, and an extending section extends from the top section and toward the bottom section to engage inside the slot. The flexible flat transmission component is disposed on the installation portion and includes a plurality of contacts. The second metal housing is assembled with the first metal housing and covers the flexible flat transmission component, and the plurality of contacts exposes out of the second metal housing.

The connector structure of the present invention utilizes the flexible flat transmission component to replace a front contact terminal and a rear cable of a conventional connector and further omits an insulating main body of the conventional connector. The connector structure of the present invention has advantages of simple structure and easy assembly, which can solve problems of the conventional connector with complicated structure, large size and high manufacturing cost.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
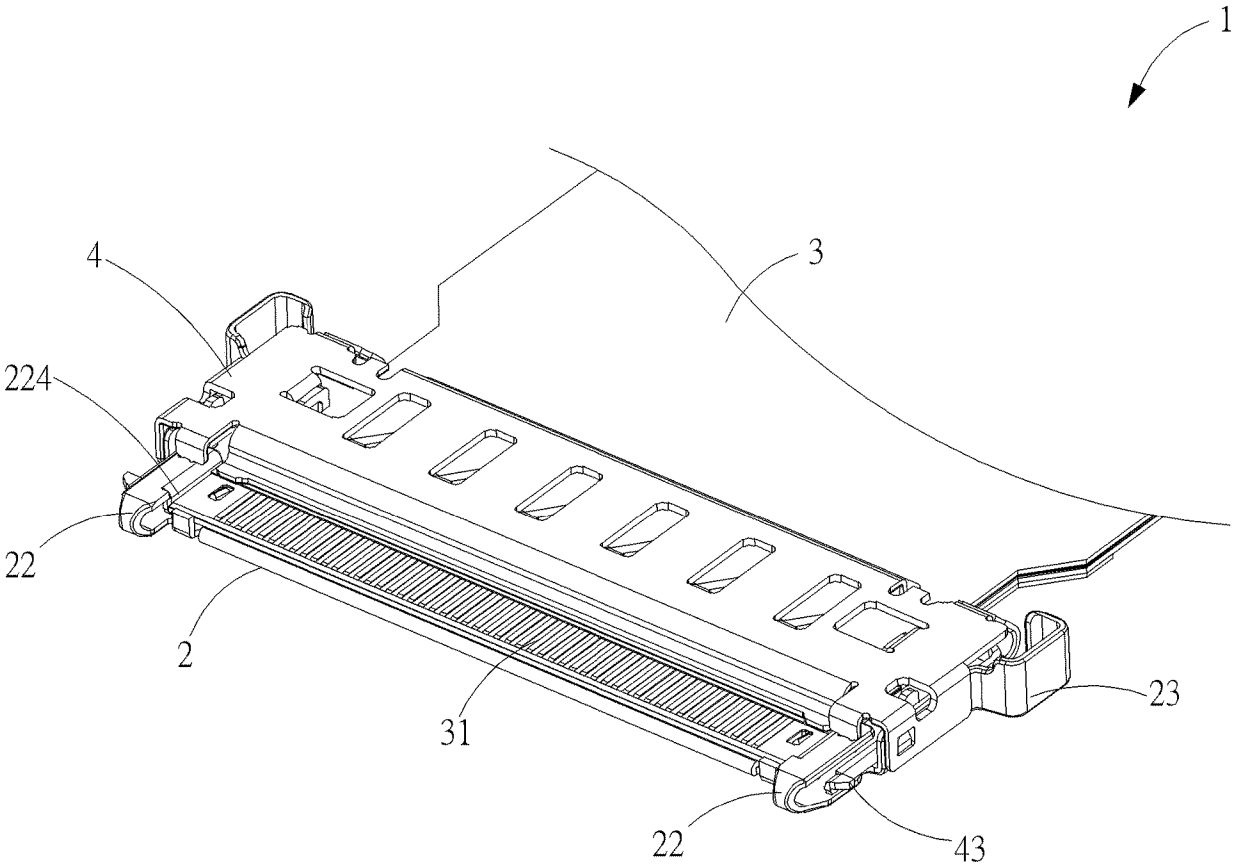
FIG. 1 is a schematic diagram of a connector structure according to an embodiment of the present invention.
Figure 2:
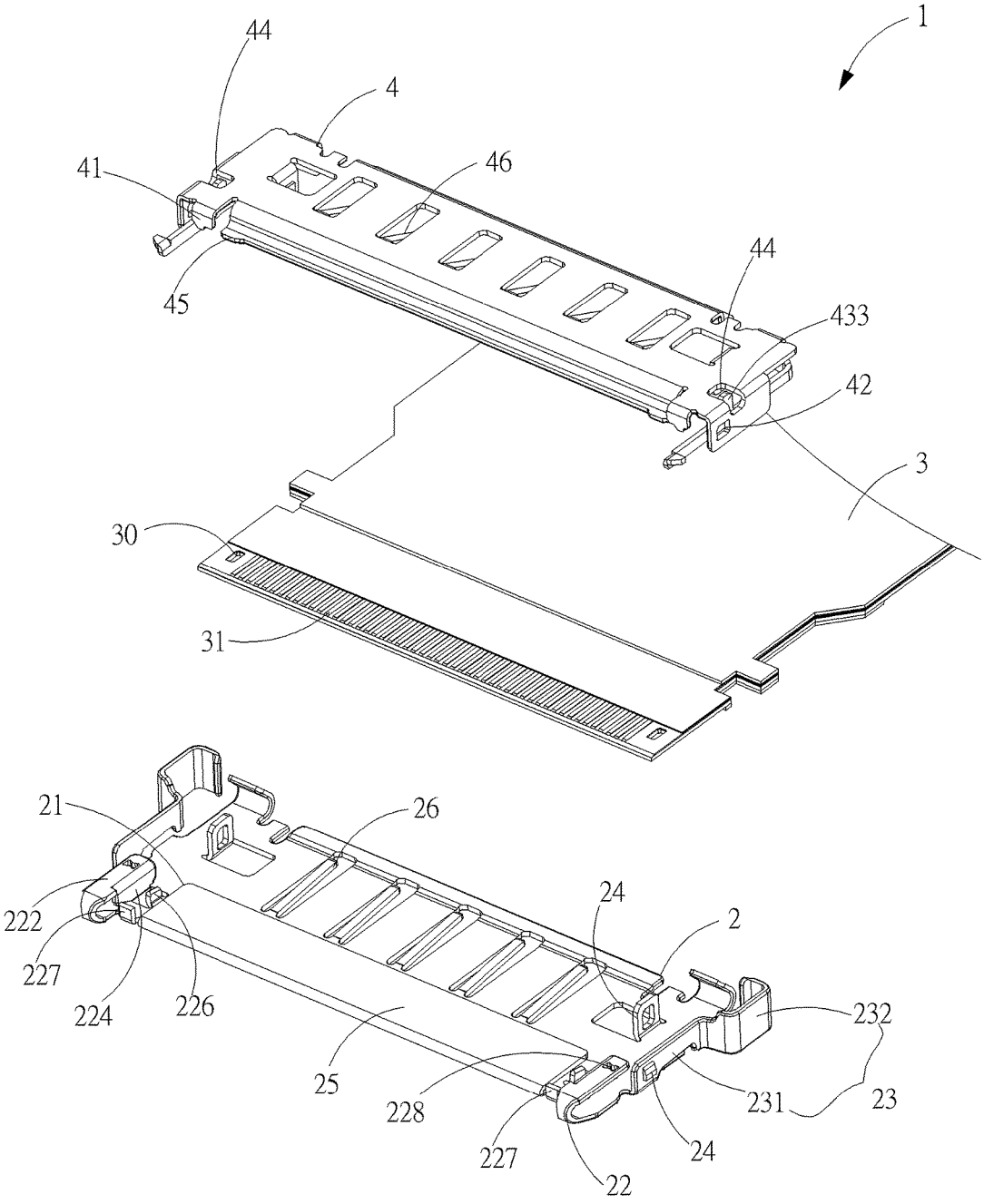
FIG. 2 is an exploded diagram of the connector structure as shown in FIG. 1 according to the embodiment of the present invention.
Figure 3:
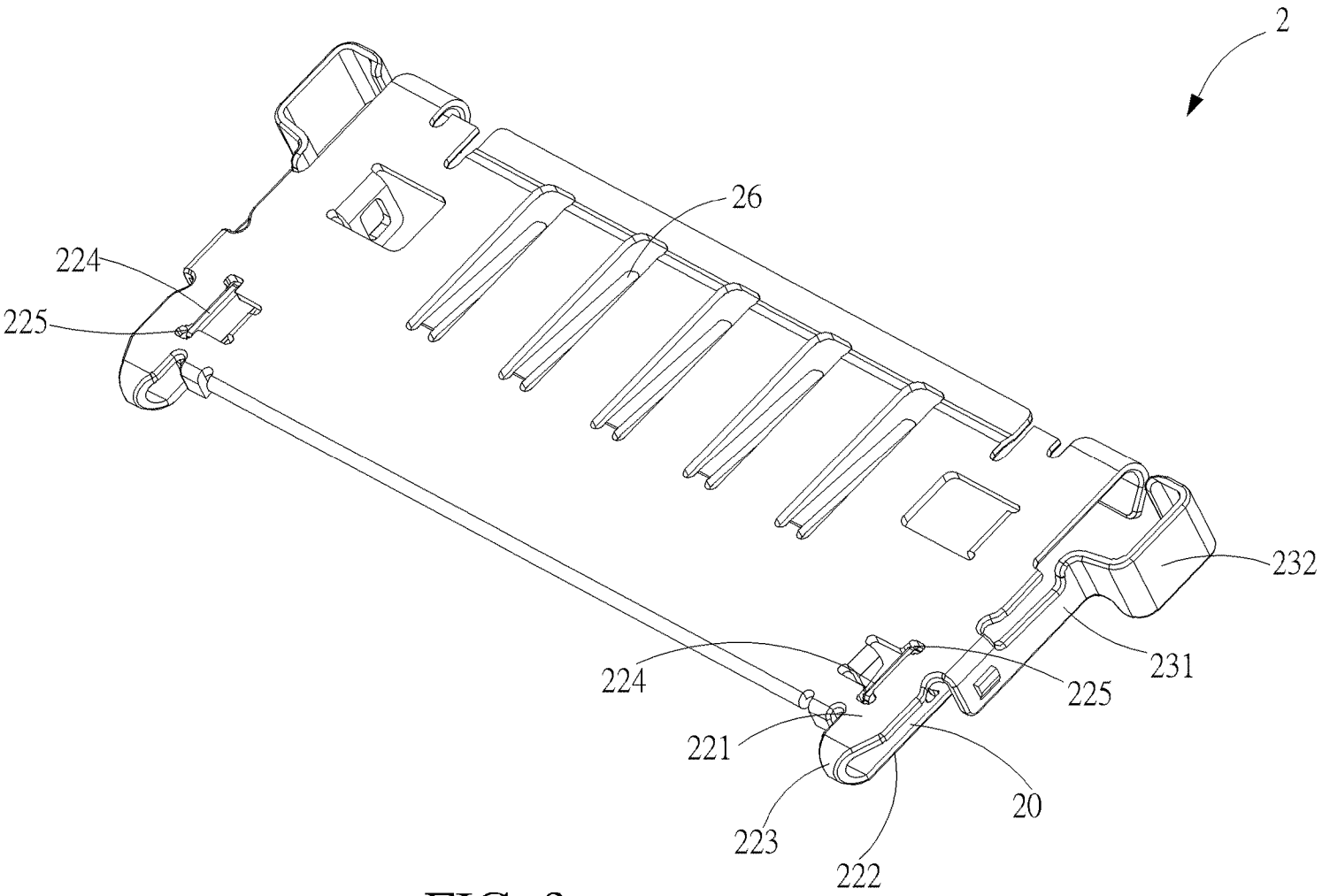
FIG. 3 is a schematic diagram of a first metal housing as shown in FIG. 2 in another view according to the embodiment of the present invention.
Figure 4:
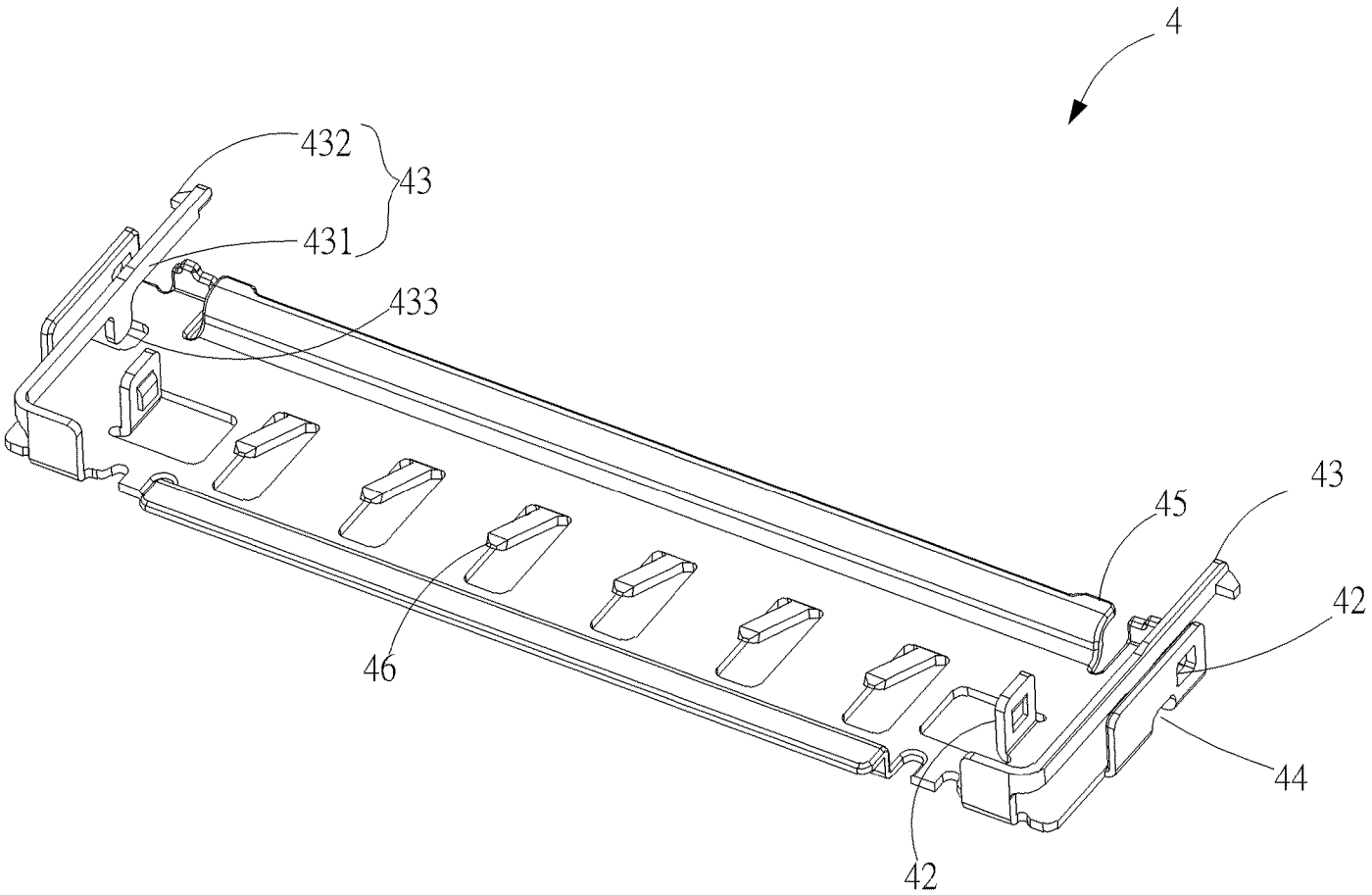
FIG. 4 is a schematic diagram of a second metal housing as shown in FIG. 2 in another view according to the embodiment of the present invention.

Please refer to FIG. 1 to FIG. 4. FIG. 1 is a schematic diagram of a connector structure 1 according to an embodiment of the present invention. FIG. 2 is an exploded diagram of the connector structure 1 as shown in FIG. 1 according to the embodiment of the present invention. FIG. 3 is a schematic diagram of a first metal housing 2 as shown in FIG. 2 in another view according to the embodiment of the present invention. FIG. 4 is a schematic diagram of a second metal housing 4 as shown in FIG. 2 in another view according to the embodiment of the present invention. The connector structure 1 includes the first metal housing 2, a flexible flat transmission component 3 and the second metal housing 4. The flexible flat transmission component 3 is clamped between the first metal housing 2 and the second metal housing 4.

The first metal housing 2 includes an installation portion 21 and two guiding portions 22 disposed on two sides of the installation portion 21. Each guiding portion 22 includes a bottom section 221, a top section 222 opposite to the bottom section 221, and a bending section 223 connected to the bottom section 221 and the top section 222. An extending section 224 extends from the top section 222. A slot 225 is formed on the bottom section 221, and the extending section 224 extends from the top section 222 and toward the bottom section 221 to engage inside the slot 225. Understandably, in this embodiment, the bottom section 221, the top section 222, the bending section 223 and the extending section 224 can be integrally formed on the first metal housing 2, so as to provide a stable guiding structure. Besides, an accommodating space 20 is formed among the top section 222, the extending section 224 and the bottom section 221.

In this embodiment, the installation portion 21 includes two protruding parts 226 at two sides. The installation portion 21 further includes two blocking parts 227 at a front edge and located in positions corresponding to the two protruding parts 226. Two releasing portions 23 are disposed on the first metal housing 2 and extend from the bottom sections 221 of the guiding portions 22 upwards and rearwards, respectively. Each releasing portion 23 includes a forcing arm 231 and a pressing part 232 disposed on a distal end of the forcing arm 231. The first metal housing 2 further includes first engaging portions 24, which can be at different types, disposed on a front end of the forcing arm 231 and the installation portion 21, for fastening with the second metal housing 4. Understandably, for enhancing connection strength and increasing thickness of connection, a folding portion 25 is disposed on the installation portion 21, and the folding portion 25 can be a structure provided with a forwardly extending edge of the installation portion 21 of the first metal housing 2 extending upwardly and backwardly. Besides, a plurality of grounding clips 26 are formed on the first metal housing 2.

The flexible flat transmission component 3 is positioned on the installation portion 21 and the folding portion 25 of the first metal housing 2. The flexible flat transmission component 3 includes a plurality of contacts 31, and the plurality of contacts 31 of the flexible flat transmission component 3 are positioned on the folding part 25, so as to enhance structural thickness and strength of connection. In this embodiment, the flexible flat transmission component 3 can be a flexible flat cable (FFC) or a flexible printed circuit (FPC) board, but is not limited thereto. At least one opening 30 is formed on the flexible flat transmission component 3. For example, two openings 30 can be formed on the flexible flat transmission component 3, and the two protruding parts 226 engage with the two openings 30 respectively, so as to locate the flexible flat transmission component 3. Besides, a front edge of the flexible flat transmission component 3 is located nearby and blocked by the two blocking parts 227, so that the two blocking parts 227 can prevent the front edge of the flexible flat transmission component 3 from moving forwardly, so as to locate the flexible flat transmission component 3. Meanwhile, two lateral sides of the flexible flat transmission component 3 are restrained between the two extending sections 224 of the two guiding portions 22 disposed on the two sides of the installation portion 21, so as to restrain the flexible flat transmission component 3 laterally.

The second metal housing 4 is assembled with the first metal housing 2, and the second metal housing 4 covers the flexible flat transmission component 3. The plurality of contacts 31 of the flexible flat transmission component 3 expose out of the second metal housing 4, so as to electrically connect with a docking connector (not shown in figures). In this embodiment, at least one inserting hole 228 is formed on the top section 222, and the second metal housing 4 includes at least one inserting portion 41 for inserting into the at least one the inserting hole 228, so as to position the first metal housing 2 and the second metal housing 4. The second metal housing 4 further includes second engaging portions 42 for engaging with the first engaging portions 24, so as to assemble the second metal housing 4 with the first metal housing 2.

In this embodiment, two locking portions 43 and two openings 44 are disposed on two sides of the second metal housing 4, respectively. Each locking portion 43 includes a resilient arm 431 and a hook 432 disposed on a distal end of the resilient arm 431, and a stopping part 433 is disposed on the resilient arm 431 and extends towards the corresponding opening 44, so as to limit a movement range of the stopping part 433 within the opening 44. When a user presses the pressing part 232, the pressing part 232 can drive the forcing arm 231 to contact and force the resilient arm 431, so as to separate the hook 432 from the docking connector. The structural design of the stopping part 433 can prevent over-deformation of the resilient arm 431.

It should be noticed that, in this embodiment, the locking portion 43 is disposed on the second metal housing 4, the releasing portion 23 is disposed on the first metal housing 2, but is not limited thereto. For example, the locking portions 43 can be disposed on the first metal housing 2, and the releasing portion 23 can disposed on the second metal housing 4, that is, the locking portion 43 can be disposed on the first metal housing 2 or the second metal housing 4 according to actual design demand. Besides, the locking portion 43 is located inside the accommodating space 20 and protected by the top section 222, the extending section 224 and the bottom section 221, so as to protect the locking portion 43 from deformation or damage by external force. Furthermore, the second metal housing 4 further includes an abutting portion 45 for abutting against the flexible flat transmission component 3 onto the first metal housing 2, so as to fasten the flexible flat transmission component 3. A plurality of grounding clips 46 are also formed on the second metal housing 4.

In contrast to the prior art, the connector structure of the present invention utilizes the flexible flat transmission component to replace a front contact terminal and a rear cable of a conventional connector and further omits an insulating main body of the conventional connector. The connector structure of the present invention has advantages of simple structure and easy assembly, which can solve problems of the conventional connector with complicated structure, large size and high manufacturing cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector structure comprising:

a first metal housing comprising an installation portion and two guiding portions disposed on two sides of the installation portion, each guiding portion comprising a bottom section, a top section opposite to the bottom section, and a bending section connected to the bottom section and the top section, a slot being formed on the bottom section, and an extending section extending from the top section and toward the bottom section to engage inside the slot;

a flexible flat transmission component disposed on the installation portion of the first metal housing, the flexible flat transmission component comprising a plurality of contacts; and a second metal housing assembled with the first metal housing and covering the flexible flat transmission component, the plurality of contacts of the flexible flat transmission component exposing out of the second metal housing.

2. The connector structure of claim 1, wherein the installation portion comprises at least one protruding part, at least one opening is formed on the flexible flat transmission component, the at least one protruding part engages with the at least one opening, and the flexible flat transmission component is clamped between the first metal housing and the second metal housing.

3. The connector structure of claim 1, wherein the installation portion comprises at least one blocking part, and a front edge of the flexible flat transmission component is located nearby the at least one blocking part.

4. The connector structure of claim 1, wherein the flexible flat transmission component is restrained between the two extending sections of the two guiding portions disposed on the two sides of the installation portion.

5. The connector structure of claim 1, wherein at least one inserting hole is formed on the top section, the second metal housing comprises at least one inserting portion for inserting into the at least one the inserting hole, the first metal housing comprises at least one first engaging portion, and the second metal housing comprises at least one second engaging portion for engaging with the at least one first engaging portion.

6. The connector structure of claim 1, wherein a folding portion is disposed on the installation portion, and the plurality of contacts of the flexible flat transmission component are positioned on the folding portion.

7. The connector structure of claim 1, further comprising:

at least one locking portion disposed on the first metal housing or the second metal housing, an accommodating space being formed among the top section, the extending section and the bottom section, and the at least one locking portion being located inside the accommodating space.

8. The connector structure of claim 7, further comprising:

a plurality of grounding clips disposed on the first metal housing or the second metal housing, the second metal housing comprising an abutting portion for abutting against the flexible flat transmission component onto the first metal housing.

9. The connector structure of claim 1, further comprising:

at least one releasing portion disposed on the first metal housing; and at least one locking portion disposed on the second metal housing.

10. The connector structure of claim 9, wherein two openings and two locking portions are disposed on two sides of the second metal housing respectively, each locking portion comprises a resilient arm and a hook disposed on an end of the resilient arm, a stopping part is disposed on the resilient arm and extends towards the corresponding opening, and the at least one releasing portion comprises a forcing arm and a pressing part disposed on an end of the forcing arm.

* * * * *